United States Patent [19]

Kohler et al.

[11] Patent Number: 4,722,313

[45] Date of Patent: Feb. 2, 1988

[54] METHOD FOR DETECTING AN EXTREME VALUE POSITION OF A MOVABLE PART

[75] Inventors: Rolf Kohler, Schwieberdingen; Günther Plapp, Filderstadt, both of Fed. Rep. of Germany

[73] Assignee: Robert Bosch GmbH, Stuttgart, Fed. Rep. of Germany

[21] Appl. No.: 809,015

[22] Filed: Dec. 13, 1985

[30] Foreign Application Priority Data

Dec. 17, 1984 [DE] Fed. Rep. of Germany ..... 3445983

[51] Int. Cl.[4] ..... F02B 3/00

[52] U.S. Cl. ..... 123/494; 73/118.1

[58] Field of Search ..... 123/494, 480, 488; 73/118; 364/424.1

[56] References Cited

U.S. PATENT DOCUMENTS 4,409,948 10/1983 Hasegawa .

4,586,403 5/1986 Lee ..... 123/480

*Primary Examiner*—Ronald B. Cox

*Attorney, Agent, or Firm*—Walter Ottesen

[57] ABSTRACT

A method is disclosed for detecting an extreme value position of a movable part by means of a position detecting sensor. The method is especially suitable for detecting the idle position of the throttle flap of an internal combustion engine with the aid of a potentiometer. In this method, a stored value (extreme value) corresponding to the extreme position is corrected upon the detection of deviating measured values, provided that the deviating measured values lie within a correction range around the extreme value. The range of movement of the movable part has to lie within the range coverable by the position sensor. After a predetermined number of identical measured values are sensed in the correction range during an operating cycle, such a measured value is stored in memory as the new extreme value. For dynamic adaptation, this next extreme value is modified cyclically, preferably prior to each operating cycle, by a predetermined value away from the outermost position. While detecting the extreme position with a high accuracy, the method of the invention has a very small hysteresis, with the full function capability being restored after a short period, even under irregular operating conditions.

6 Claims, 4 Drawing Figures

METHOD FOR DETECTING AN EXTREME VALUE POSITION OF A MOVABLE PART

FIELD OF THE INVENTION

The invention relates to a method for detecting an extreme value position of a movable part, particularly for detecting the idle position of the throttle flap of an internal combustion engine.

BACKGROUND OF THE INVENTION

German published patent application DE-OS No. 24 42 373 discloses an electrically controlled intermittent fuel-injection apparatus wherein injection signals are generated on the basis of rotational speed and throttle flap position. In this application, the throttle flap position is sensed by means of a potentiometer.

With a view to accomplishing optimum metering of fuel, it is necessary for the throttle flap position to be detected with a high degree of accuracy, particularly in the range of relatively small opening angles of the throttle flap. For example, for adjusting idle speed, an idle position of the throttle flap has to be detected for which purpose an idle switch is conventionally used. However, the idle stop is subject to changes due to both idle-speed adjustment and mechanical wear of the limit stop. It is, however, necessary that the idle position of the throttle flap be detected within a very small angular range of about 0.3° because it is only in this range that the air flows are sufficiently small to keep the torque change within tolerable limits when the fuel supply is cut off or resumed by means of the overrun mode of operation.

German published patent application DE-OS No. 34 28 879 discloses a digital method for detecting the idle condition; in this known method, the slider path of the position sensor, which is configured as a potentiometer, is subdivided into increments. A stored limit value is followed-on with a specific time constant in dependence on measured values. For follow-on, however, a constant angular swing between minimum value and maximum value has to be taken into consideration, with the entire measuring range eventually being followed on. This method is not particularly suitable, especially for non-linear potentiometers.

SUMMARY OF THE INVENTION

It is an object of the invention to improve upon the known method referred to in the foregoing such that an isolated extreme value can be adapted at high accuracy and fast adaptation, even under irregular operating conditions and large angular differences, without the opposite lying extreme value exercising an influence.

The method of the invention affords the advantage that by virtue of a very small hysteresis and reliable detection of the idle position, an accurate adjustment and detection of this position is assured.

Further advantages and embodiments of the method of the invention will become apparent from the subsequent description in conjunction with the drawing and from the claims.

BRIEF DESCRIPTION OF THE DRAWING

The invention will now be described with reference to the drawing wherein.

DESCRIPTION OF THE PREFERRED EMBODIMENT OF THE INVENTION

Figure 1:
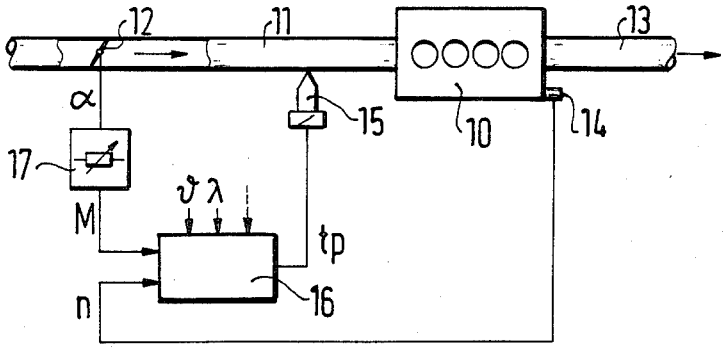
FIG. 1 is a schematic of an electronically controlled fuel-injection apparatus wherein throttle flap position and rotational speed are processed as the most important operating characteristic quantities.

FIG. 1 discloses the basic configuration of an electronically controlled and preferably intermittent operating fuel-injection apparatus operating on the basis of signals indicative of rotational speed and throttle flap angular position. An apparatus of this type is already known and disclosed, for example, in DE-OS No. 24 42 373 referred to above.

An internal combustion engine 10 receives intake air through an intake pipe 11 accommodating a throttle flap 12. An exhaust pipe 13 is at its other end. A rotational speed sensor 14 detects the instantaneous speed of the crankshaft and determines, together with the angular position $\alpha$ of the throttle flap 12, an injection signal $t_p$ for an injection valve 15 corresponding to the intake pipe 11. In addition to rotational speed and throttle flap position, further operating characteristic quantities such as temperature and Lambda value are, as a rule, fed into a control unit 16 for electronic fuel injection. This is indicated in FIG. 1 by further imputs on the control unit 16.

Figure 3:
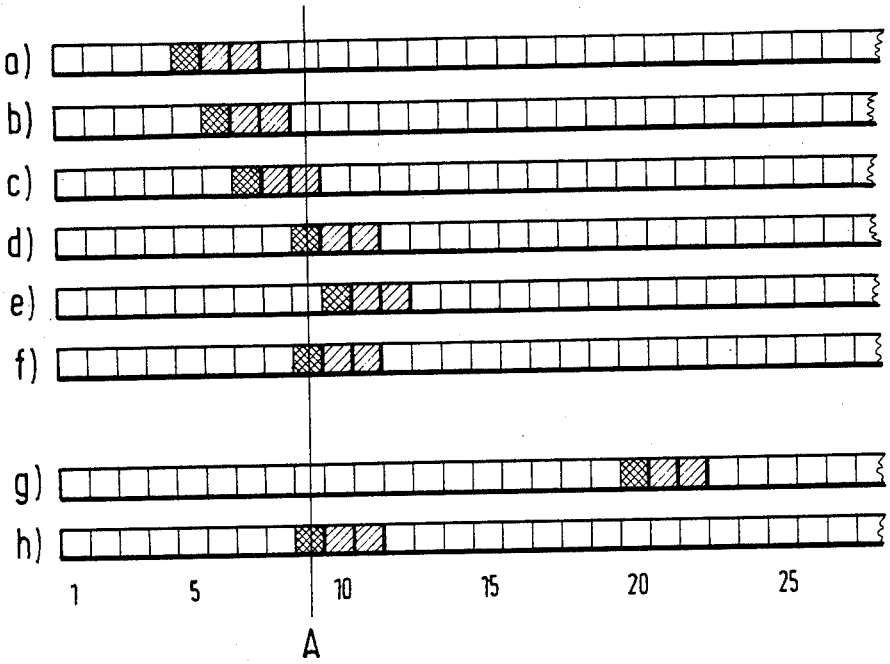
FIG. 3 shows various examples of an irregular shift of the idle position and its correction; and, FIG. 4 is a flowchart explaining the operation of detecting the idle position.

In this arrangement, the position $\alpha$ of the throttle flap 12 is sensed by a potentiometer 17 and applied to the control unit 16 as measured value M. The potentiometer operating voltage of, for example 5 volts, drops along the entire slider path of potentiometer 17. When subdividing the slider path of the potentiometer into increments and using an 8-bit system, 256 increments will result over the entire length of the slider path. Since the range of mechanical adjustment of the throttle flap 12 has to be within the range of adjustment of the potentiometer, a specific data word will result for the mechanical throttle stop A (idle position) which corresponds to a very low voltage or a low number of increments. In FIG. 3, the mechanical stop A corresponds to nine increments. Mechanical displacement of the potentiometer relative to the throttle flap because of age, wear of the limit stops and further error quantities can effect the idle position of the throttle flap. A continuous adaptation process using purely electronic means ensures that the exact idle position can always be detected.

Figure 2:
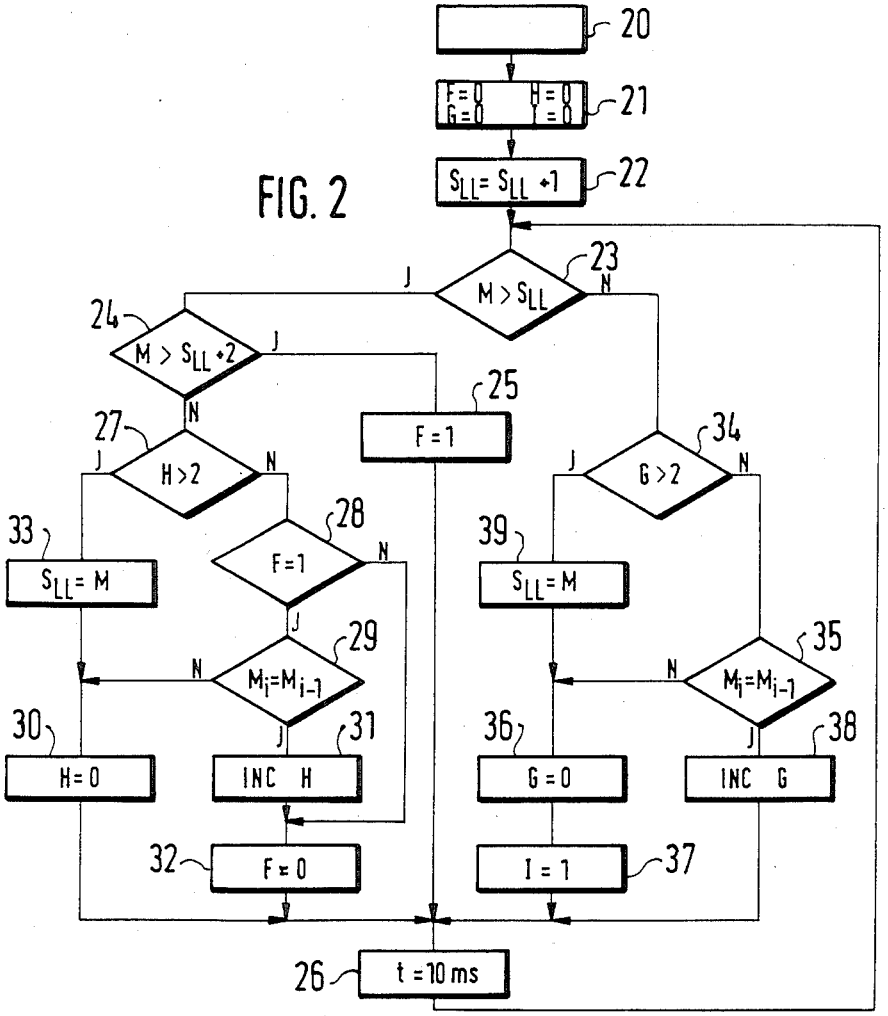
FIG. 2 is a flowchart of an embodiment according to the method of the invention.

The operation of the adaptation process will now be described with reference to FIGS. 2 and 3.

The adaptation process starts at 20 after the supply voltage is switched on (through the ignition, for example), after the internal combustion engine is started and after the engine temperature has exceeded a predetermined threshold. This represents the beginning of an operating cycle which ends by turning off the internal combustion engine or interrupting the voltage supply. Start 20 is followed by an initialization at 21 in which four storage cells or registers F, H, G and I are set to zero value. Finally, in step 22, the stored value of the idle position $S_{LL}$ is increased by one increment. The next step 23 is an inquiry determining whether the instantaneous measured value M is greater than the stored idle value $S_{LL}$.

If this is the case, inquiry step 24 determines whether M is outside a partial correction range bounded by $S_{LL}$ on the one end and by $S_{LL+2}$ on the other end. If the answer is yes, that is, if the condition $M > S_{LL+2}$ is satisfied, register F is set to the value 1 in step 25 and, after a delay of 10 ms, the program returns in a loop back to inquiry 23. The clock pulses for the inquiry of measured value M are preset in step 26. The loop made up of steps 23 to 26 is then run through repeatedly until the measured value M is within the correction range.

If the condition of inquiry 24 is no longer fulfilled, inquiry step 27 determines whether the register value of register H is greater than 2. At this time, this condition is not satisfied so that inquiry step 28 checks whether register F has the value 1 which is now the case. The next inquiry step 29 determines whether measured value M has already occurred once before ($M_i = M_{i-1}$). Since this is not the case, register H is set to zero in step 30, the value zero being present at that time anyway, and the program is returned to inquiry 23 after the preset clock time. Steps 23, 24, 27, 28 and 29 are then repeated provided that the appropriate conditions still prevail. In inquiry step 29, it is now determined that the measured value M has already occurred before, so that register H is incremented by 1 in process step 31. Thereafter, register F is set to the value zero in process step 32 and a return to step 23 after the preset clock time.

If the same measured value M continues to be present, steps 24, 27, 28 are then run through. In this sequence, it is determined in inquiry step 28 that register F no longer has the value 1, as a result of which there is a return to inquiry step 23 via process steps 32 and 26. As long as measured value M remains unchanged, the loop described will be run through unchanged until the measured value M exceeds the value $S_{LL+2}$ (inquiry step 24), which causes register F to be reset to 1 in process step 25. Steps 23, 24, 25, 26 of the loop are then repeated until measured value M ceases to satisfy the condition of inquiry step 24.

For further incrementation of register H in process step 31, it is necessary that the condition of inquiry step 29 be fulfilled, that is, that the detected measured value M was already identically sensed previously. In this case, register H can now be incremented by 1 to the value 2.

In order to fulfill the condition of inquiry step 27 ($H > 2$), it is thus necessary that loop 1 (steps 23, 24, 25, 26), loop 2 (steps 23, 24, 27, 28, 29, 30, 26) and loop 3 (steps 23, 24, 27, 28, 29, 31, 32, 26) and again thereafter, that loop 1 and loop 3 are run through in double alternation. Stated otherwise, if it is established that value M has occurred identically four times, with at least one measured value which fulfills inquiry condition 24 being required to occur three times in between, then this measured value M will be stored as the new idle value $S_{LL}$ in step 33. Since thereafter in process step 30, register H is reset to zero value, the entire process sequence has to be repeated to modify value $S_{LL}$ again. This procedure is based on the assumption that a measured value which occurs repeatedly in an identical manner in the proximity of the stored idle value, must be the actual idle value.

If it is determined in inquiry step 23 that measured value M is less than the stored idle value $S_{LL}$ again, it can be concluded immediately herefrom that measured value M approaches the actual idle value more than does the stored idle value. Accordingly, the inquiry whether this measured value is in the proximity of the stored idle value is therefore superfluous. In inquiry step 34 it is therefore immediately determined whether the contents of register G are greater than 2 which is not the case at this time. In inquiry step 35 it is then established that the detected measured value M has not yet occurred previously, so that in steps 36, 37, registers G and I are set to zero and one, respectively, and a return to inquiry step 23 is made via process step 26. In the next run through, after inquiry steps 23, 34, 35, register G is incremented in process step 38 since it was now established in step 35 that measured value M already occurred once before. The loop 23, 34, 35, 38, 26 is run through until register G is equal to 3, always on condition that measured value M is maintained in an identical manner. In process step 39, this measured value M, which has now occurred several times, is then stored as the new idle value $S_{LL}$. Thereafter, registers G and I are again reset to zero and one, respectively.

Referring now to FIG. 3, the measured value should correspond to idle stop value A. The stored idle value is shown crosshatched in each example while the two increments to the right thereof are shown hatched and represent the portion of the correction range to the right of the idle value.

In line a, the stored idle value corresponds to value 5. Consequently, only the loop made up of steps 23, 24, 25, 26 is run through in this operating cycle. In the following operating cycle, the stored idle value is increased by one increment in process step 22 (line b); however, the loop made up of steps 23, 24, 25, 26 is again run through.

In the third operating cycle shown in line c, condition 24 is no longer satisfied, that is, the measured value is now within the correction range. If an identical measured value M then occurs four times in an identical manner as described, this measured value will then be stored as the new idle value $S_{LL}$ in the same operating cycle, as shown in line d. In the fourth cycle, directly following, the new idle value is first incremented again in process step 22 as shown in line e. It is now established in step 23 that the measured value is less than the stored idle value. Accordingly, and pursuant to the above, after a four time identical occurrence, this measured value will be stored as the new idle value as illustrated in line f.

As lines g and h show, the stored idle value is determined again in the same operating cycle if the measured value drops below the stored idle value, irrespective of how large the deviation is from the hitherto idle value.

As an alternative to process step 22, instead of being increased by one increment, the stored idle value may be increased at the beginning of an operating cycle by a number of increments which correspond to the maximum possible idle position of the throttle flap during warm-up of the internal combustion engine. This number of increments corresponds to an angular position of 20°, for example. In this case, the engine temperature will not be needed in step 20 as a start condition. At the beginning of warm-up, the angle of the throttle flap adjusts to a high idle value which is then detected and stored by means of process steps 34 to 39. As the idle angle slowly returns to the limit stop with the engine temperature rising, the stored idle value will follow this changing value by continuous adaptation. In this connection and for the detection of idle, the successful completion of at least one adaptation process should be awaited.

Figure 4:
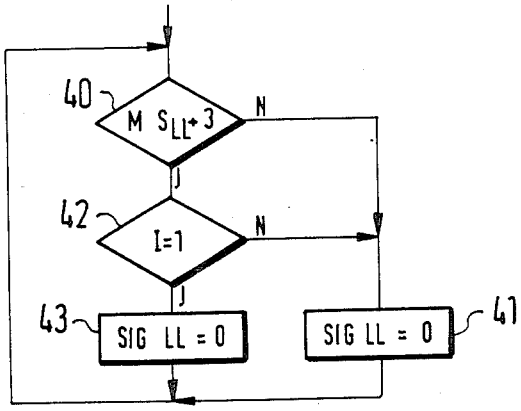

FIG. 4 explains the logical decision in control unit 16 on whether or not the idle position is present. For this purpose, an inquiry is made in inquiry step 40 as to whether the measured value M present at this instant is less than the stored idle value $S_{LL}$ increased by three increments, that is, whether the measured value is within a hatched area according to FIG. 3. If this is not the case, no idle position is detected in process step 41. On the other hand, if the conditions are present, inquiry step 42 determines whether register I contains the value 1. This is only true if at least one measured value has been detected previously which is below the idle value $S_{LL}$ (see process steps 35 and 37). This inquiry step 42 is necessary for the reliable determination of the idle if at the beginning of an operating cycle the stored idle value $S_{LL}$ has been increased in process Step 22 by a large amount which is above the idle position during warm-up. By contrast, if the stored idle value $S_{LL}$ was increased by only one increment as shown in FIG. 2, inquiry step 42 may be omitted. With the condition of inquiry step 40 and, where applicable, of inquiry step 42 fulfilled, the idle position is then detected in process step 43.

Provided that the values of a characteristic or of a characteristic field are selected by means of the measured values of the throttle flap position in control unit 16, (for example, for the determination of the duration of injection), it is necessary that after an adaptation, that is, after a shift of the idle position relative to the value originally entered, also a corresponding shift of the characteristic or of the characteristic field occurs. Each newly determined and stored idle value is held in a non-volatile or buffered memory store where it is available immediately after a new start of the internal combustion engine.

It is understood that the method described is not limited to the detection of the idle position of a throttle flap but is in principle suitable for the detection of an end position of any desired movable part capable of performing both linear and non-linear movements. Further, the invention is not restricted to the detection of just a starting position of such a movable part, but may be also used for the detection of the end position, or any extreme value position. Finally, other position sensors such as optical, inductive and capacitive systems, for example, are also suitable for use in addition to potentiometers.

If on initial start-up no stored extreme value is yet present or if the extreme value is deleted or subject to some disturbance, an initialization adaptation may be preferably provided which is initiated, for example, by applying a specific pin of the control unit to ground. This enables the control unit to detect that an initialization adaptation should be performed. During this mode of operation, the smallest value measured will be interpreted as the idle value. Apart from a plausibility check, this adaptation is not subject to a stationary or dynamic restriction. For example, the plausibility check may establish whether the detected measured values are within a range that may be considered as an extreme value position.

It is understood that the foregoing description is that of the preferred embodiments of the invention and that various changes and modifications may be made thereto without departing from the spirit and scope of the invention as defined in the appended claims.

What is claimed is:

1. In an internal combustion engine having an engine-speed determining movable part, a method of detecting an extreme value position of the movable part with position detecting means, the range of movement of the movable part being within the range detectable by said position detecting means and the method comprising the following steps for correcting a stored value corresponding to the extreme value position:

defining a correction range around said extreme value which extends from the outermost position detectable by said position detecting means over said stored value and up to a predetermined number of increments beyond said stored value;

detecting a predetermined number of identical measured values in said correction range during an operational cycle and, in at least that part of said range starting at said stored value and facing away from said outermost position, said identical measured values being only then detected when measured values outside of said correction range are detected between said identical measured values;

storing a measured value corresponding to one of said measured values as a new extreme value; and, cyclically changing said stored extreme value away from the outermost position by a predetermined value.

2. The method of claim 1, wherein said cyclic change of the stored extreme value takes place before each operating cycle.

3. The method of claim 2, said change being one increment.

4. The method of claim 2, wherein the internal combustion engine is a gasoline engine and the movable part is the throttle flap of the engine and, wherein the change in each instance amounts to a number of increments corresponding to an angle, the angle corresponding to the idle throttle flap angle required in the warm-up phase of the engine.

5. The method of claim 1, wherein an initialization adaptation is switched in by means of a switching signal while the smallest occurring measured value is interpreted and stored as an extreme value.

6. The method of claim 2, wherein the internal combustion engine is a gasoline engine and the movable part is the throttle flap of the engine and, wherein the change in each instance amounts to a number of increments corresponding to an angle, the angle corresponding to the upper limit of the throttle flap.

* * * * *